US006148467A

United States Patent [19]

Martinsson

[11] Patent Number: 6,148,467

[45] **Date of Patent: *Nov. 21, 2000**

[54] PAINTING TOOL

[75] Inventor: Kenneth Martinsson, Bankeryd, Sweden

[73] Assignee: Ab Habo Specialpenslar Forsaljning, Bankeryd, Sweden

[ * ] Notice: This patent issued on a continued prosecution application filed under 37 CFR 1.53(d), and is subject to the twenty year patent term provisions of 35 U.S.C. 154(a)(2).

[21] Appl. No.: 09/090,993

[22] Filed: Jun. 5, 1998

Related U.S. Application Data

[63] Continuation of application No. PCT/SE96/01476, Nov. 14, 1996.

[30] Foreign Application Priority Data

Dec. 8, 1995 [SE] Sweden ..... 9504412

[51] Int. Cl.[7] ..... F16D 1/10; F16B 7/10

[52] U.S. Cl. ..... 15/172; 15/144.1; 15/145; 15/176.6

[58] Field of Search ..... 15/172, 144.1, 15/145, 201, 176.1, 176.6, 228

[56] References Cited

U.S. PATENT DOCUMENTS

| | | | |
|---|---|---|---|
| 165,583 | 7/1875 | Hood et al. | 15/144.1 |
| 911,791 | 2/1909 | Whitney | 15/144.1 |
| 1,994,677 | 3/1935 | Wildhaber | 15/145 |
| 2,581,141 | 1/1952 | Raptis | 15/172 |
| 2,679,657 | 6/1954 | Krueger | 15/172 |
| 2,887,710 | 5/1959 | Mahoney | 15/172 |
| 4,715,080 | 12/1987 | Rydzicki | 15/172 |
| 4,727,618 | 3/1988 | Mahoney | 15/172 |
| 4,819,293 | 4/1989 | Nicholson | 15/172 |
| 5,033,154 | 7/1991 | Marchand et al. | 15/172 |

FOREIGN PATENT DOCUMENTS

| | | | |
|---|---|---|---|
| 541 138 A1 | 5/1993 | European Pat. Off. . | |
| 1102498 | 3/1961 | Germany | 15/145 |
| 199743 | 11/1938 | Switzerland | 15/172 |
| 287826 | 4/1953 | Switzerland | 15/144.1 |
| 750773 | 6/1956 | United Kingdom | 15/144.1 |

*Primary Examiner*—Gary K. Graham
*Attorney, Agent, or Firm*—Pillsbury Madison & Sutro LLP

[57] ABSTRACT

The present invention is for a paint applicator, brush or similar painting tool, the handle(2) of which can easily be set between two different positions during ongoing work. Shaft and bristle parts of a paint-brush according to the invention have been divided along a plane which somewhat deviates from a plane which is parallel to an imaginary axis along the paint-brush parallel to the bristles. The two parts of the brush are joined by a shaft or the like which is at right angle to the dividing plane.

9 Claims, 3 Drawing Sheets

PAINTING TOOL

This is a continuation of: International Appln. No. PCT/SE96/01476 filed Nov. 14, 1996 which designated the U.S.

FIELD OF THE INVENTION

The present invention is for a brush or similar tool for the application of paint or other liquid onto surfaces.

BACKGROUND OF THE INVENTION

In painting jobs brushes and similar devices of different kinds of size and design of brush and handle parts are used. By large jobs, as for example the painting of building exteriors, several different kinds of brushes are used. Besides the width and shape of the brush part there are also two common kinds of handles, both straight paint, brushes with a handle which is in line with the brush and paint brushes where the handles is at an angle to the direction of the bristle. This difference is important, both in order to obtain ergonomicly correct conditions for the work and to obtain a high quality of the work performed. This brings with it a considerable increase of the number of brushes used for a single job and a corresponding increase of the assortment which shall be supplied by manufacturers, wholesalers and detail dealers. In addition thereto the frequent exchange of paint-brushes during an ongoing painting job is an additional work which requires time and brings costs with it. Brushes and similar tools are in connection herewith used for example also to apply washing and cleaning liquids.

SUMMARY OF THE INVENTION

The present invention is for a brush, paint brush or the like painting tool, the handle of which can easily be shifted between two different positions during an ongoing job, whereby an exchange of paint-brush is avoided. The object of the present invention is a brush of that kind where the angle of the handle to the bristle can be set between two well defined positions in such a way that it does not cause any play between the handle and the brush parts or other disadvantage. Another object of the invention is to make it possible to shift between the two positions by a simple manual setting during ongoing job.

The handle and bristle parts of a paint-brush according to the invention are divided along a plane which deviates somewhat from a plane which is at right angle to an imaginary axis along the length of the paint brush parallel to the bristle. The two parts of the paint brush are joined by means of a shaft or the like which is at right angle to the dividing plane.

The invention will below be more closely described with reference to the example of an embodiment thereof which is shown in the enclosed figures.

DETAILED DESCRIPTION OF THE DRAWINGS

Figure 1:
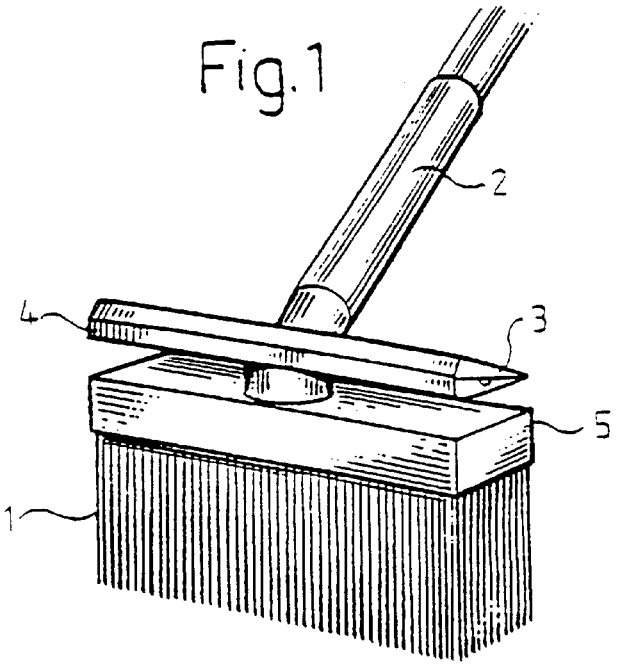
FIG. 1 shows a paint brush according to the invention with the handle in an angle position.

The paint brush of FIG. 1 has a handle 2 connected to a bristle holder 5, by means of which the bristle 1 is attached. Between the handle 2 and the bristle holder 5 there is a can hook in the shape of wings 3, 4 which are used to hang the paint brush on the edge of the paint can at shorter breaks of work.

Figure 2:
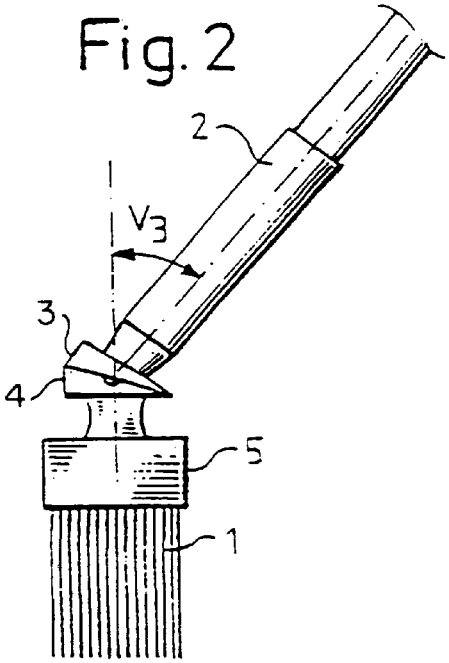
FIGS. 2 and 3 show the paint brush of FIG. 1 with the handle in the two different possible positions.
Figure 4:
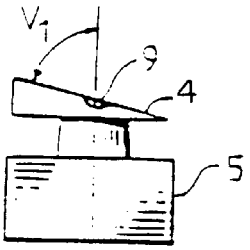
FIG. 4 shows a partly sidewise view of a part of the bristle holder of the brush of FIG. 1.

A paint brush according to the invention can be shifted between the two positions which are shown in FIGS 2 and 4.

Figure 3:
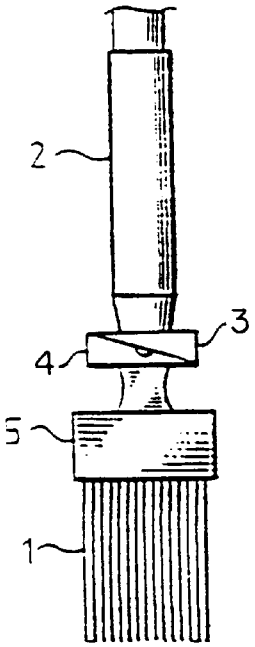

In FIG. 2 the handle is at an angle V3 with the direction of the bristles, while FIG. 3 shows a second position where the handle is positioned in the extension of the direction of the bristles. In another embodiment of the invention the direction of the handle may also in the position of FIG. 2 have a direction which is different from that of the bristles and it may form an angle which is smaller than V3 with the direction of the bristles.

The resetting between the two positions is made by turning the handle 180° in respect of the bristle part. For this purpose the paint brush is divided in a plane through the wings of the can holder and it has here devices for keeping the two parts together and for locking them in a satisfactory way in the two desired positions.

Figure 5:
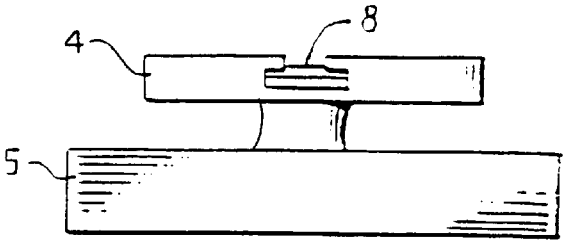
FIG. 5 shows the bristle holder according to FIG. 4 in a front view.
Figure 6:
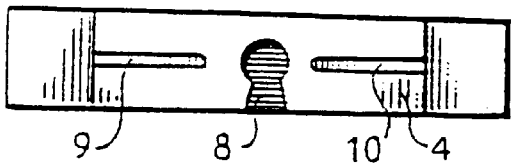
FIG. 6 shows the bristle holder according to FIGS. 4 and 5 from above.

The bristle holder with the appurtenant part of the can holder is shown in FIG. 4 seen from the short side of the paint-brush and in FIG. 5 seen from its long side and in FIG. 6 seen from above. On the upper side of the wings of the can holder there are grooves 9 and 10 which extend from the outer edge of the wings towards the middle. In the middle of the can holder there is a cut-in comprising a recess 8 having a keyhole-like upwards opening. The hole 8 is intended to receive a means which is joined to the shaft in order to join the shaft and brush parts, while the grooves 9 and 10 are intended to cooperate with corresponding notches 11, 12 on the opposed surface and thereby keep the parts in one of the two desired positions.

Figure 7:
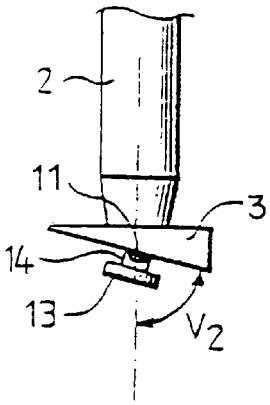
FIG. 7 shows the end of the shaft part of the paint-brush of FIG. 1 in a side view.
Figure 8:
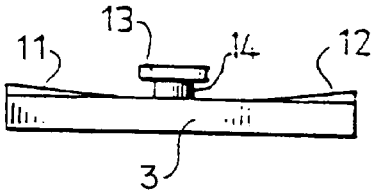
FIG. 8 is another view of the shaft part of FIG. 7.
Figure 9:
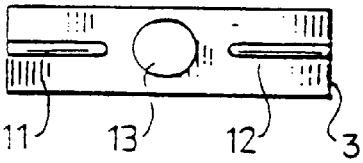
FIG. 9 shows the shaft part of FIG. 7 from above.
Figure 10:
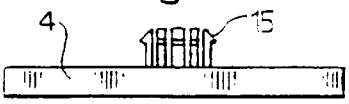
FIG. 10 shows the shaft part according to another embodiment of the invention.

FIGS. 7, 8 and 9 show in a way corresponding the FIGS. 4, 5 and 6 one end of the handle of the paint brush. A part of the wings of the can holder being a part of the handle is delimited by an essentially flat surface which forms and angle V2 to the length direction of the handle. The angle V3 between the two parts will in one position be V3=(V1+V2) and in the other position V3=(V1−V2), assuming that if V1 and V2 are different so is V1 the greater angle. If one of the two positions in which the paint brush and the handle can be set the paint brush and the bristle are in line with each other the angles V1 and V2 shall be equal. On the angled surface there are notches 11, 12 which correspond to grooves 9, 10 in the opposite surface of the brush part. In the middle of the inclined surface there is also a fastening means having the shape of a circular plate 13 which is joined to the surface by means of a shaft 14. Bristle part and handle are joined thereby that the plates 13 is brought into the hole 8, whereby the shaft 14 passes through the keyhole-like opening of the hole 8 and is snapfastened at the inner part thereof.

In at least one of the brush part or the handle part, the wings of the can holder are made from a somewhat resilient material, preferably both the brushholder and the handle are entirely made from a suitable plastic material which may be the same as is used for paint brushes of known kinds. The notches 11 and 12 have their maximum heights at the outer ends of the wings and become narrower towards the middle thereof. This simplifies the mounting which preferably takes place with the two parts of the can holder at right angle to each other. When the handle thereafter has been turned so that the notches 11 and 12 fit into the grooves 9 and 10, the handle and the brush are held relative to each other in this position with sufficient strength to make it possible to perform ordinary painting job uneffected of the turning possibility. When the angle of the handle shall be adjusted, for example from straight to bent to enable work at a different position and using an extension of the handle, this can by a simple grip be turned 180° relative to the bristle holder into its new position. No more action is required and mounting of the two parts, loosening of locking devices or similar actions are thus completely avoided.

Figure 11:
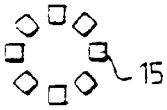
FIG. 11 shows the shaft part of FIG. 10 from above.
Figure 12:
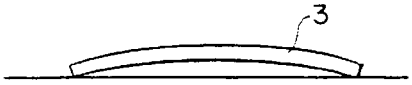
FIG. 12 shows more in detail the pretension of the shaft part.
Figure 13:
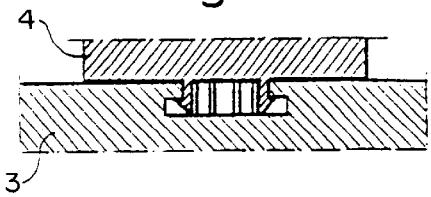
FIG. 13 is a cross section through the shaft and the bristle holder of the embodiment of FIGS. 10–12.

Another embodiment of the invention is shown in FIGS. 10–13. Also in this case the division between the handle and the bristle holder is in the wings of the can holder, and as described above these have grooves and notches. In order to join the two parts there is in one part, for example the handle, instead of mounting means with keyhole in the brush part and mounting button in the handle part, a number of mounting hooks 15 placed in a ring in a position which corresponds to the mounting button 13 of the embodiment described above. In the bristle holder there is a circular hole which corresponds to the mounting hooks and has a circumferential edge, as shown in FIG. 13 which shows a cross-section of the parts when put together. Preferably the mounting hooks are positioned in a circle, as shown in FIG. 11. In order to further ensure that there is no unwanted movements between the handle part and the brush part, the wings of the can holder may preferably at the handle part be pretensioned, as shown in FIG. 12. The pretensioning means that they are produced slightly bent and thereby exercise a greater pressure on the corresponding part of the wings of the other part of the paint brush.

Figure 14:
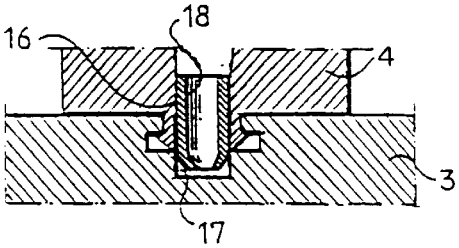
FIG. 14 is a cross section of the modification of the embodiment of FIG. 13.

In an improved embodiment the hooks 15 are joined by a thin sheet of plastic material between the hooks at least up to half the height of the hooks. A further improvement is achieved by the embodiment which is shown in FIG. 14. Hereby the handle has a through hole 16 along its length parallel to the direction of the hooks and a corresponding hole 17 shaped as a cavity is arranged in the bristle part of the brush. After that the two parts of the paint brush have been mounted together, a plug 18 of a suitable dimension is inserted through the handle and forced in between the hooks 15. Hereby it is avoided that the hooks may bend inwards when the paint brush is used and the parts thereby unintentionally are made free from each other. The above mentioned thin sheet which connects the hooks means that if a hook is broken it is kept in its proper position, whereby a weekening of the construction is avoided.

Figure 15:
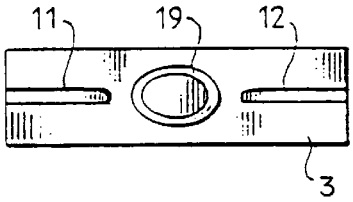
FIGS. 15–17 show another embodiment of the invention in views corresponding to FIGS. 6, 8 and 9.
Figure 16:
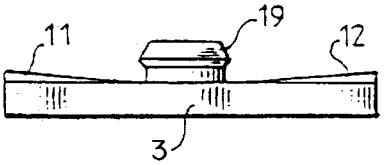
Figure 17:
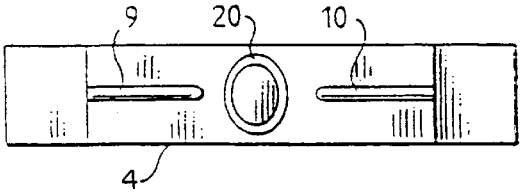

A preferred embodiment of the invention is shown in FIGS. 15–17. Therein the hooks 15 have been substituted for by a ring 19 which has mainly the same cross-section as the hooks. The ring is somewhat oval or elliptic and there is a corresponding hole 20 with the same oval or elliptic shape in the other part of the paint brush. In the figures the oval shape has been exaggerated in order to clearly show the principle of the design. In the hole 20 there is an edge to which the edge of the ring corresponding to the points of the hooks is snap-fastened. When the two parts shall be mounted together, they are held in a position between the two working positions, so that the oval shape of the hole and the ring coincide. Thereupon the handle is turned 90° to either direction to the desired working position, whereby the force keeping the parts together is further strengthen thereby that the oval or ellipses in these positions are at right angles to each other. In order to simplify the mounting the ring can be split up in two parts by means of two opposite cuts of suitable height and depth.

What has been described above is only non-limiting examples of embodiments of a paint brush according to the invention. Within the inventive idea this can be varied for example as to the method of mounting together the handle and brush parts. Moreover and already mentioned is the possibility to vary the inclination angle between the brush part and the handle part in different ways by varying the angles V1 and V2 in the manufacturing. It has turned out to be advantageous to put the dividing between the brush and the handle parts in the wings which are formed by the can holder but also other positions of the dividing plane are possible.

What is claimed is:

1. A variable positioning tool for the application of paint or other liquid onto surfaces, said tool comprising:

a brush part with two ends, having bristles extending from one end and as mounting surface on the other end; and a handle part with two ends, having an elongated handle extending from one end and a mounting surface on the other end with a shaft extending therefrom;

wherein the mounting surface of said handle part and the mounting surface of said brush part are divided from each other along a dividing plane which deviates somewhat from a plane at right angles to an imaginary axis along the length of said tool parallel to the bristles, said brush part and said handle part of said tool being joined together by means of the shaft of said handle part which is at a right angle to the dividing plane and said mounting surfaces and around which said brush part may be turned relative to said handle part; and wherein the mounting surface of said brush part and the mounting surface of said handle part have interengaging means for cooperation with each other such that the mounting surface of said brush part interlocks with and snaps into place with the mounting surface of said handle part at a first predetermined position and at a second predetermined position, said first predetermined position being located when the handle is aligned with the bristles extension and said second predetermined position being located when said handle part is turned relative to the brush part approximately 180° from said first predetermined position such that the handle is inclined with respect to the bristle extension.

2. A variable positioning tool according to claim 1, wherein the mounting surface of said brush part and said handle part of said tool are essentially flat surfaces along the dividing plane, the structure of the mounting surface of said brush part being one of a groove and a projection which engages with a mating one of a groove and a projection of said handle part.

3. A variable positioning tool according to claim 2, wherein at least one of the mounting surfaces is pretensioned so that in a released position said at least one surface is concave relative to the opposing surface.

4. A brush tool for applying paint or other liquids to a surface, comprising:

a brush part having bristles disposed on one end and a mounting surface on another end; and a handle part having an elongated handle extending from said one end and amounting surface on another end with a shaft extending therefrom, said handle surface of said handle part mating with the mounting surface of the brush part;

wherein one of the parts include a wedge-shaped member defining its respective mounting surface;

wherein the shaft comprises a projecting member having a neck portion which extends into an elliptical head portion, and the brush part has an opening in its mounting surface adapted to receive the elliptical head portion, the head portion having a width larger than the neck portion, wherein one of the mounting surfaces includes diametrically opposed engaging members disposed at sides of the projection member or the opening, respectively, and the other mounting surface includes diametrically opposed slots, the head portion of the projecting member being insertable into the opening such that the brush tool may be secured in first and second operable positions; and wherein the brush part is rotatable with respect to the handle part about an axis of the neck portion of the projecting member to establish the first and second operable positions, said axis extending perpendicular to said mounting surfaces, the first operable position being established when the engaging members fully engage the slots, the second operable position being established when the handle part is rotated from the first operable position such that the engaging members re-engage the slots, each of the engaging members in the second operable position engaging a different slot than when in the first operable position, the brush tool being resettable to the first and second operable positions, and when in the first operable position, the handle is aligned with the bristles and when in the second operable position, the handle is inclined with respect to the bristles.

5. The brush tool as defined in claim 4, wherein inner walls of the opening terminate in a shelf portion opposite to the mounting surface, the shelf portion providing a ledge against which the head portion of the projection member can rest when the head portion is inserted into the opening and the handle part is turned with respect to the brush part, the head portion securely being retained thereby.

6. The brush tool as defined in claim 4, wherein the head portion of the projection member is ring-shaped.

7. The brush tool according to claim 6 wherein the opening is a keyhole-shaped opening adapted to receive the projecting member to thereby join the brush part with the handle part.

8. The brush tool according to claim 6, wherein inner walls of the opening terminate in a shelf portion opposite to the mounting surface, the shelf portion providing a ledge against which the head portion of the projecting member can rest when the head portion is inserted into the opening and the handle part is turned with respect to the brush part, the head portion being securely retained thereby; and wherein the head portion of the projecting member comprises a plurality of resilient mounting hooks, the hooks being compressible into the opening to engage the shelf portion.

9. A brush tool for applying paint or other liquids to a surface, comprising:

a brush part having bristles disposed on one end and a mounting surface on another end; and a handle part having an elongated handle extending from said one end and a mounting surface on another end with a shaft extending therefrom, said handle surface of said handle part mating with the mounting surface of the brush part;

wherein one of the parts include a wedge-shaped member defining its respective mounting surface;

wherein one of the mounting surfaces has a projecting member having a neck portion which extends into a head portion, and the brush part has an opening in its mounting surface adapted to receive the head portion, the head portion having a width larger than the neck portion, wherein one of the mounting surfaces includes diametrically opposed engaging members disposed at sides of the projection member or the opening, respectively, and the other mounting surface includes diametrically opposed slots, the head portion of the projecting member being insertable into the opening such that the brush tool may be secured in first and second operable positions; and wherein the brush part is rotatable with respect to the handle part about an axis of the neck portion of the projecting member to establish the first and second operable positions, said axis extending perpendicular to said mounting surfaces, the first operable position being established when the engaging members fully engage the slots, the second operable position being established when the handle part is rotated from the first operable position such that the engaging members re-engage the slots, each of the engaging members in the second operable position engaging a different slot than when in the first operable position, the brush tool being resettable to the first and second operable positions, and when in the first operable position, the handle is aligned with the bristles and when in the second operable position, the handle part is inclined with respect to a direction of the bristles.

* * * * *